US007896315B2

(12) United States Patent
Faust

(10) Patent No.: US 7,896,315 B2
(45) Date of Patent: Mar. 1, 2011

(54) CONTROL AND REGULATION DEVICE FOR SAFEGUARDING A CONVEYOR DEVICE, CONVEYOR DEVICE AND CRANE UNIT

(75) Inventor: Dirk Faust, Freudenberg (DE)

(73) Assignee: Pintsch Bubenzer GmbH, Kirchen-Wehbach (DE)

( * ) Notice: Subject to any disclaimer, the term of this patent is extended or adjusted under 35 U.S.C. 154(b) by 253 days.

(21) Appl. No.: 12/161,401

(22) PCT Filed: Dec. 19, 2006

(86) PCT No.: PCT/EP2006/012257

§ 371 (c)(1),
(2), (4) Date: Aug. 13, 2008

(87) PCT Pub. No.: WO2007/085293

PCT Pub. Date: Aug. 2, 2007

(65) Prior Publication Data

US 2010/0206831 A1 Aug. 19, 2010

(30) Foreign Application Priority Data

Jan. 26, 2006 (DE) ..... 10 2006 003 832

(51) Int. Cl.
*B66D 1/50* (2006.01)

(52) U.S. Cl. ..... 254/275; 254/278; 254/294; 254/319; 254/347

(58) Field of Classification Search ..... 254/267, 254/269, 274, 275, 278, 290, 294, 300, 318, 254/319, 340, 346, 347
See application file for complete search history.

(56) References Cited

U.S. PATENT DOCUMENTS 3,870,255 A * 3/1975 Lemont ..... 244/137.1

(Continued)

FOREIGN PATENT DOCUMENTS

CA 1147835 A1 6/1983

(Continued)

OTHER PUBLICATIONS

English-language translation of International Preliminary Report on Patentability issued on the corresponding PCT application.

(Continued)

*Primary Examiner*—Emmanuel M Marcelo
(74) *Attorney, Agent, or Firm*—Hooker & Habib, P.C.

(57) ABSTRACT

A control and regulation arrangement for protection of a conveyor or other hoisting or crane device that assures a safe reaction to overloading. A brake apparatus is provided that acts on the conveyor under control of an overload sensor. If the load approaches a predetermined threshold, a signal is emitted from the overload sensor and transmitted to a speed sensor that limits the conveyor speed. Simultaneously the control transmits a signal to the brake apparatus to actuate and stop the conveyor. Upon receipt of a subsequent signal that a load relief state is to be established, the control brakes the conveyor in accord with the speed signal such that the object in transport moves toward a safe position at a constant speed. A conveyor with multiple hoisting devices may include duplicate control and regulation arrangements for each hoisting device.

14 Claims, 3 Drawing Sheets

U.S. PATENT DOCUMENTS

Figure 1:
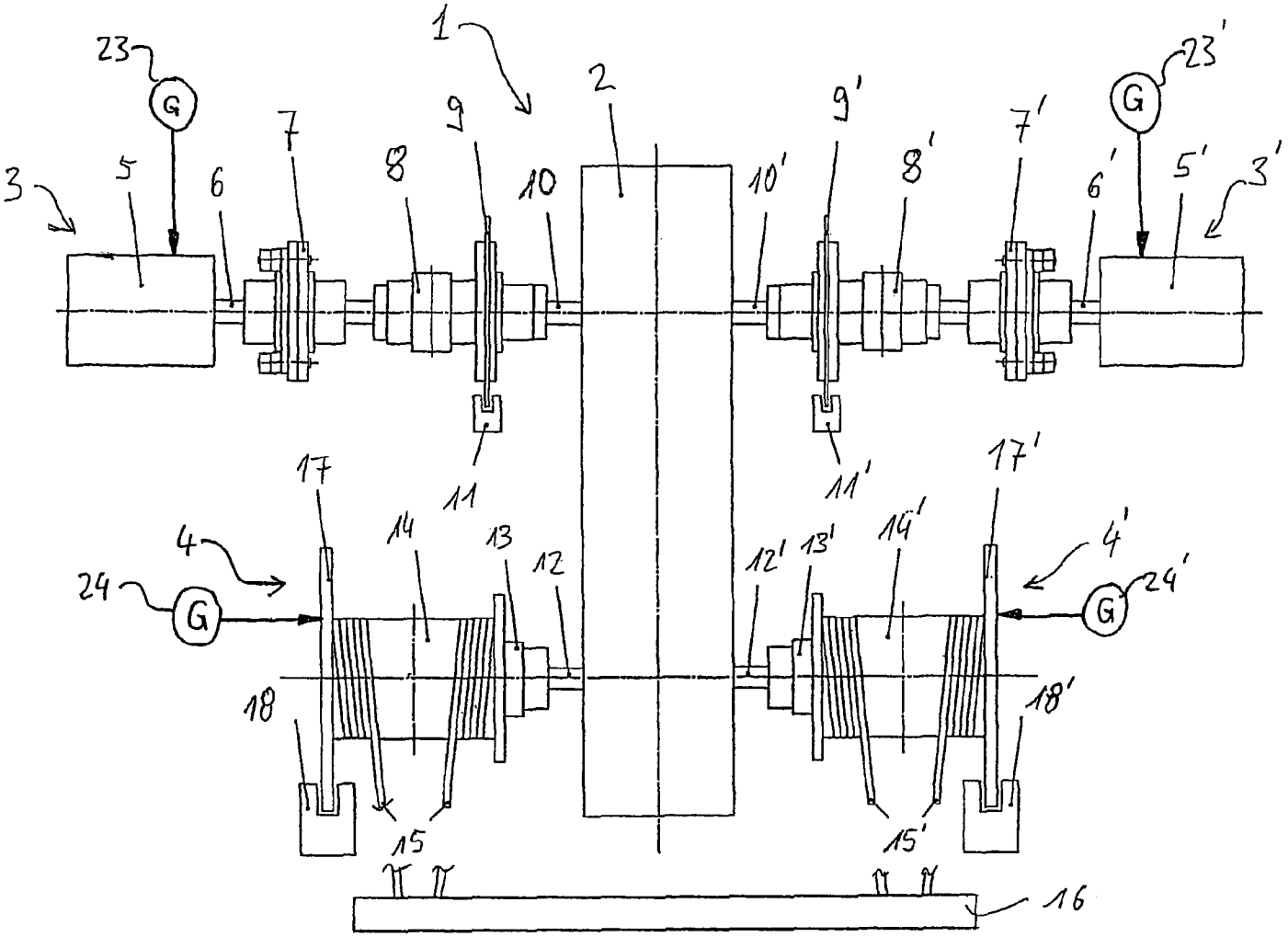

| | | | | |
|---|---|---|---|---|
| 4,597,497 | A * | 7/1986 | Aberegg | 212/274 |
| 4,821,842 | A | 4/1989 | Cavalieri | |
| 6,655,662 | B2 * | 12/2003 | Kemppainen | 254/275 |
| 2002/0033481 | A1 * | 3/2002 | Kemppainen | 254/275 |

FOREIGN PATENT DOCUMENTS

| | | | |
|---|---|---|---|
| DE | 3003148 | A1 | 8/1980 |
| DE | 3341414 | A1 | 5/1985 |
| DE | 20219282 | U1 | 5/2004 |
| EP | 1661845 | A1 | 5/2006 |
| RU | 2265571 | C2 | 11/2004 |
| RU | 2271985 | C2 | 3/2005 |

OTHER PUBLICATIONS

Official communication issued by Russian Federation Federal Service for Intellectual Property, Patents and Trademarks in corresponding Russian patent application (with German translation), 6 pages.

* cited by examiner

CONTROL AND REGULATION DEVICE FOR SAFEGUARDING A CONVEYOR DEVICE, CONVEYOR DEVICE AND CRANE UNIT

The present invention concerns a control and regulation arrangement for protection of a conveyor, this being, for example, a crane with attendant lifting and structural components. The control arrangement is designed to provide a protective reaction when a conveying overload is detected. That is, the control functions when the transport load exceeds a predetermined threshold value. The cited overloads can occur, especially in the case of cranes, elevators or other vertical lift devices, when the lifted object in transport is too heavy, and/or engages itself in surrounding structures or becomes jammed therein. Especially with a hoist-equipped crane, the danger is present, that while the load is in an upward, lifting movement, it becomes restricted by immovable objects intruding into its defined path of motion. In such a case it is possible, that a hoisting overload can occur, which can dangerously damage the lifting apparatus, or again, if a free standing crane be involved, this can be toppled from its position of rest.

In cases of known protective measures for overload, for example as these are brought forth in DE 202 19 282 U1, an overload coupling, when subjected to overload, is caused to isolate a lifting cable hoist drum from its driving mechanism. When such an action occurs, correction is found, in that an object in transport can be subjected to automatic lowering by the action of a controlled brake.

Crane equipment designed for ship containers present special problems. These problems arise in cases of the so-called "container bridges". A container bridge is a superstructure of a crane system, which permits the transfer of containers from a closely confined storage aboard ship to a storage or transport point ashore. Obviously, a reverse conveyance is possible. During such transfer action, the container can enter its close storage space in a skewed posture and thus be jammed, making further movement difficult. The operational loadings caused thereby can lead to a severe overloading of the crane bridging structure, upon efforts to free the said container. In an excessive case of such overload, the said container bridge can suffer failure and collapse. Snag-overload systems are known to act by detecting the overload and activating hydraulically controlled, sliding clamps to relieve the hoisting cables of tension. Accordingly, the suspended container can be extricated from its restricted position. When so freed, the container can then be properly transported through its intended path. Hydraulically controlled sliding arrangements of this kind are very expensive and require considerable maintenance. In addition, a complex cable guidance system is required to accommodate the said relief measure. This is especially true, if, as is to be expected in the case of container bridges, two hoisting cables are required for each spreader bar, which cables must be synchronized in operation. In cases of this kind, a snag-overload system is required for each hoisting cable assembly.

Before this background, the purpose of the present invention is to simplify such snag-overload systems.

In accord with the invention, this purpose is to be achieved by means of a control and regulation arrangement. In this arrangement, brake equipment is provided, which acts upon the object in transport and also upon a control system under which the said brake equipment is to function.

The concept of "control", hereinafter, can encompass an "open" regulatory system, which reacts to one or more input values or one or more output values but not to extraneous effects. The concept of "control" can also include a "closed" regulatory system, which reacts to one or more input values but said values are biased by a feedback cycle assuring regulation corresponding to actual conditions. Consequently, in the following text, the concept of "control" is to refer to a system which functions within either regulatory system.

The invented control system includes as an integral component, a sensor, which detects overload and emits a signal thereof. This signal activates functions within the control system. In addition, speed sensors are provided, which react to the speed of the travel of the object in transport and issue corresponding speed signals. As this action proceeds, the control, in response to an overload signal, acts upon the brake equipment in such a manner, that travel is blocked in the existing direction of transport, thereby protecting the object in transport and consequently movement of the carried goods is thereby interrupted. Upon the receipt of a subsequent load-relief signal, the control allows hoisting equipment—by means of an appropriate adjustment of the brake equipment—a freedom to such an extent that the hoist, in correlation with the resistance to movement of the object in transport, enters into a predetermined control centered, state of release. In the case of a crane governed by this state of release, the object in transport is lowered to permit correction. The action of the braking on such controlled transport, is that that the object in transport is permitted to enter into a properly aligned position at an approximately constant transport speed. A safe vertical transport speed is assured, in that this is caused to correspond to a velocity signal of the respective speed sensor.

The control arrangement, in accord with the invention, permits reliable and accurate detection of an overload. This accurate detection is enabled by use of redundant safety components, which have been provided for the conveyor, i.e., for the crane, the hoist and the aforesaid container bridge. For example, the invented brake equipment protects the object under transport even during a power interruption. A further advantage is that for the invented control system, no exceptionally complex construction is required.

The brake system may be designed to be spring loaded and to possess compressed air features, whereby brakes can be disengaged. The control acts, in this case, by varying the governing air pressure. The compressed air system may be electrohydraulically designed. In such a design, a frequency controlled electric motor functions in common with a hydraulic pump. This arrangement builds up pressure in the air system to oppose spring loading of the brake and thus release the brake mechanism. The control must then act through a frequency converter, whereby the frequency becomes a speed control means for the electric motor of the electrohydraulic air system, thereby regulating the combined hydraulic-air pressure. Such coacting electrohydraulic compressed air systems have proved themselves to be robust and reliable in the commercially available braking mechanisms of conveyors, in which they are frequently employed.

The control may be a "frequency-control", wherein a frequency-curve is embedded in the memory of the control. The selection and configuration of the frequency-curve permits a simple matching of a control system to the varied characteristics of the braking and those of the conveyor. In this way, it becomes possible to include such elements as the limiting constraints of the braking system, which would include the resilience of a crane structure and the elasticity of the hoisting cable. Consideration of the braking system would include: brake type, brake structure and coaction of brake shoes and brake shoe retainers. Further inclusion in the brake characteristics would be such lag and delay as may be present in the air operated control thereof.

To regulate the speed of material movement, a slope curve may be provided as a control element during motion of the transfer in the overload relief state. This guidance functions in accord with an overstepping or an understepping of a first or a second, i.e. an increased or a decreased, conveying speed. Such a frequency slope, permits exact regulation of the brake equipment. Advantageously, the slope of the frequency curve is so selectable, that feedback from resulting brake action can generally be eliminated.

A second brake design and the action thereof is also disclosed. In this arrangement, the operational safety during an overload occasion is increased. Further, the overloading of critical operational components in the conveyance apparatus can be more efficiently restrained, that is to say, the overload stress can be brought to a lower level.

A second set of brake equipment may also be provided and this additional set is likewise blocked by the issuance of the overload signal. This second brake system permits, for example, a decreasing of inner stress in a drive train, which takes place before the actual state of relief of the conveyor is established. Such inner stress can be found, for example, in the presence of delayed reactions upon individual components in the drive train. During an overload incident, this second, or additional, brake system creates a corresponding second protective measure in favor of the object being transported.

The control may direct a hydraulic valve, which relieves the pressure in a hydraulic (or electrohydraulic air unit). This has the effect of reliably and directly blocking the second braking unit without the involvement of electrical circuit "detours".

The hydraulic valve, may be constructed in such a manner, that the output pressure is so quickly decreased, that the braking action takes place within a time range of 40 to 70 milliseconds.

The disclosed invention also may concern the overload signal and the detection of an overload situation. The overload signal may be released by means of an overload coupling, wherein a separation of two halves of such a coupling occurs. Putting this overload coupling to use to generate an overload warning signal assures, that first, the desired case of overload is detected and its effect lessened and second that an erroneous reaction of the control may occur. This is true, particularly in cases wherein an overload situation does not actually exist. The separation of the coupling components may be detected by sensing the difference in speeds of rotation between the shaft before and after the said overload coupling. In the design according to claim 11, the separation, that is to say, the breaking apart, of the overload coupling, is detected by a thereto connected proximity switch, which reacts to the separation of the coupling during overload.

A conveyor may be provided with an invented control and regulation arrangement, wherein the transfer apparatus is described as a crane and is designed to possess an aforesaid container bridge structure. In the case of a crane of this design, the invented control and regulation is particularly of advantage since the arrangement can satisfactorily function with snag-overload difficulties.

A container bridge may be provided which is equipped with two, end located, synchronized hoisting mechanisms. Container bridges of this description are synchronized to make rapid load exchanges with a minimum of pendulous load swinging and with as little disturbance to the object transported as possible. To meet these conditions, the two end hoists possess a common control system.

An arrangement, wherein the control acts upon the brake of one hoist or on the brake of both hoists, so that in a case of overload a positional trimming correction can be carried out may be provided. The trimming action is such that the control orients the spreader so as to bring, for example, a skewed, suspended container into a leveled and safe position.

Figure 2:
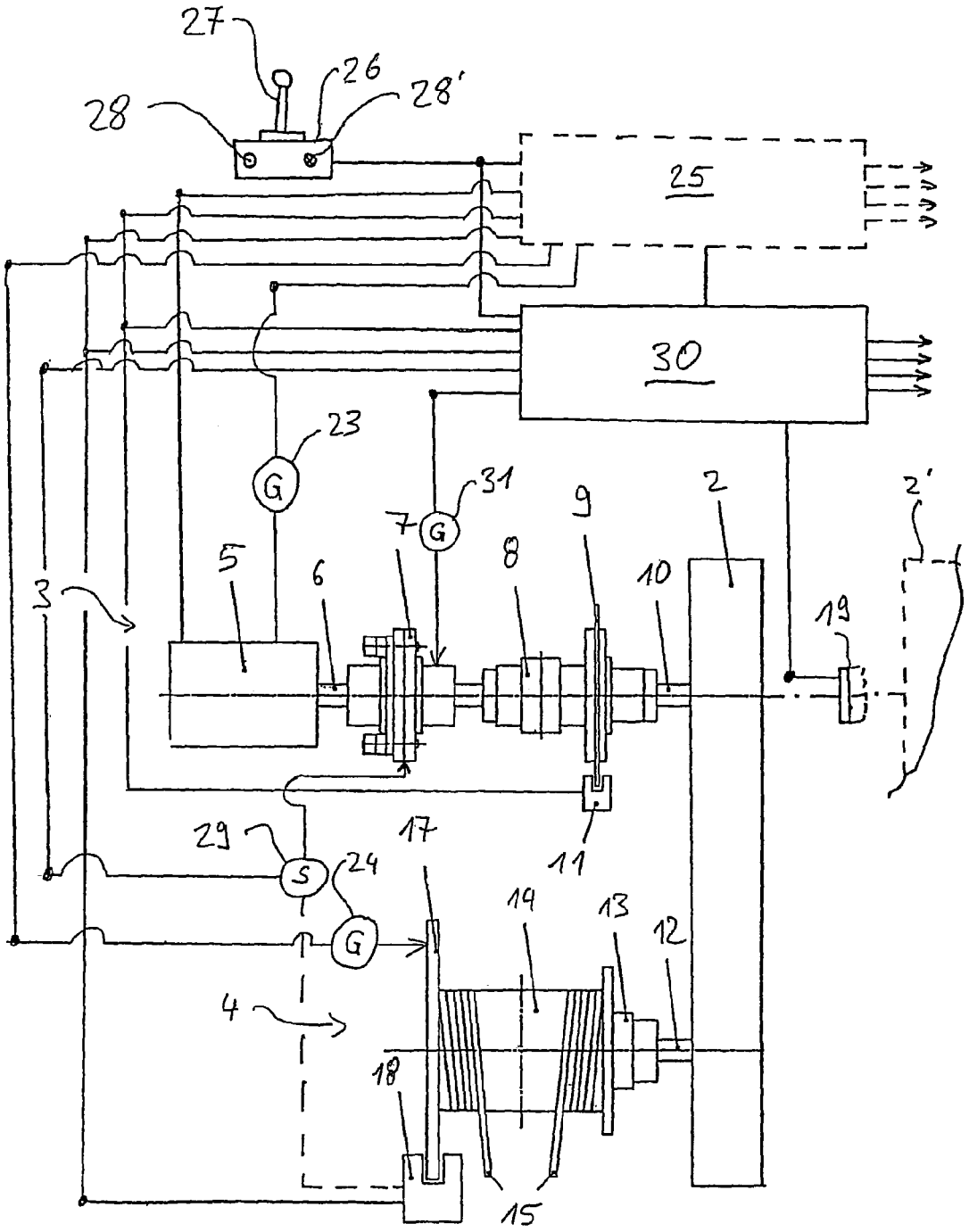
Figure 3:
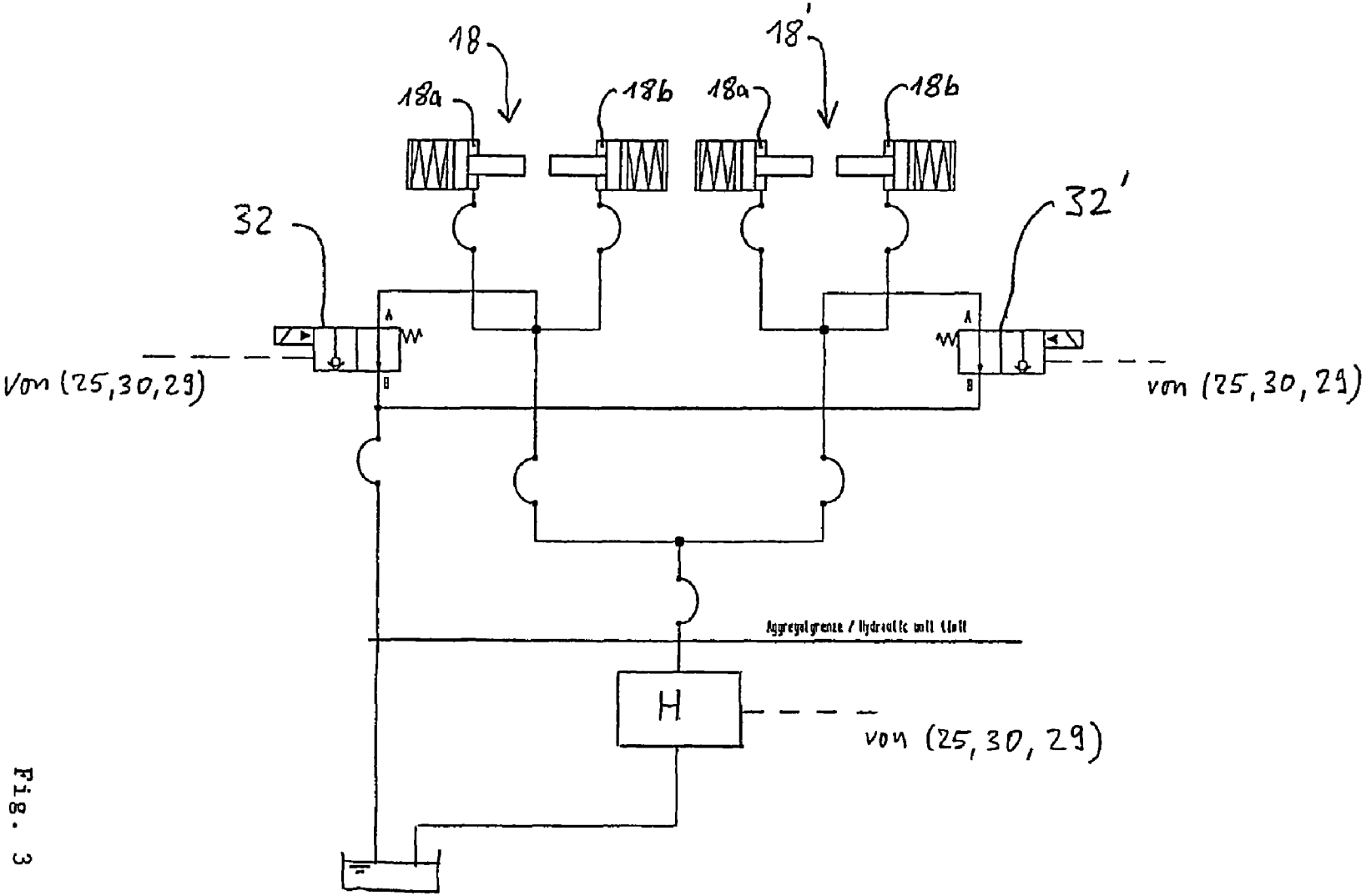

The present invention is now described in greater detail by means of reference to drawings illustrating one favorable embodiment. There is shown in:

FIG. 1: a lifting device with two cable operated hoists, designed for a container crane, FIG. 2: a detail of a lifting device (from FIG. 1) including a schematic presentation of a control arrangement, and FIG. 3: a schematic diagram of a hydraulic system which shows the control of the braking system.

The lifting equipment 1 illustrated in FIG. 1 encompasses two cable operated hoists and possesses, in combination with a gear drive 2, two drive and driven trains, these being respectively 3, 3', 4, 4'. In the following explanation, the principal components of the power path trains will be described, wherein their respective parts are designated on the drawing by reference numbers on the left side and the same reference numbers on the right side, the latter being differentiated by an apostrophe.

The drive motor 5, 5' rotates a drive shaft 6, 6' to activate an overload coupling 7, 7', wherein the torque is further conducted by a conventional coupling 8, 8', which, in turn is connected to brake disk 9, 9'. Section 10, 10' of the drive shaft furnishes power to a gear drive 2. The described brake disk 9, 9' is governed by a brake caliper 11, 11' (hereinafter designated as "service brake"). The output shaft 12, 12' of the gear drive 2 acts through a coupling 13, 13' upon a cable winding drum 14, 14' which, by means of a thereon attached cable 15, 15', lifts or lowers an object in transport 16. The cable 15, 15', which can be at least doubled per drum, is normally attached to a spreader to compensate for the length of the object in transport 16, which, for example, can be a shipboard container with hoisting clips at its corners. The spreader is not shown.

On the drum 14, 14' is to be found an additional brake disk 17, 17' upon which a protective service brake 18, 18' acts. The drive trains 3, 3' are mutually synchronized with each other by means of the gear drive 2 which joins them by the schematically indicated coupling 19 (for 19, see FIG. 2). Coupling 19 is designed as a separable, magnetically operated coupling. The coupling of the drive train 3, 3' assures a synchronized rise and lowering movement of the object in transport 16. In the case of a separated coupling 19, an independent operation of the drive trains 3, 3' could be carried out. In this embodiment, the aforesaid trimming can also be effected, in order to bring a skewed container 16, for instance, into a safe horizontal position. Conventionally, the motors 5, 5' drive the drums 14, 14' by means of the gear drive 2 and thus raise or lower the object in transport. For the execution of control, speed of rotation sensors 23, 23', 24, 24' have been connected into both the drive train 3, 3' as well as the driven train 24, 24'.

The control of the hoisting system is now described with the aid of FIG. 2. FIG. 2 shows input and output drives, respectively 3, 4, which represent the left side of FIG. 1 and the connection to the crane control 25 of the operational element 26. In the conventional manner, signals are sent to the control 25 over this operational element 26 with additional (not shown) service units. The said signals travel over appropriate control lines to act upon the motor 5 and the service brakes 11, 18. The said crane control 25 carries out all the regulation and control functions necessary for normal operation. Further, this crane control 25 acts not only on the lifting equipment components which are shown in FIG. 2, but also on those components shown on the right side of FIG. 1. The up and down travel is then, under these circumstances, so controlled by the operational element 26, that a so-called joystick 27 equipped box possesses trimming buttons 28, 28' with which two lifted ends can be independently and separately brought to an even positioning by trimming.

If an overload condition occurs, the action will be as follows: The overload coupling 7 is set at a predetermined maximal overload torque (as delivered from motor 5 to the drive shaft 10). If this set torque threshold is overstepped, then the two halves of the overload coupling 7 separate themselves, one from the other. This kind of a threshold torque can occur, if (for example) the object in transport 16, for instance, is a container, becomes wedged in its upward path, that is to say, when an equivalent of the weight of the object in transport 16 becomes too great. In other words, when the lifted load appears to be too heavy, then the parting of the overload coupling 7 separates the motor drive from the drive shaft 10. This shaft, under these conditions, will carry no further load.

The separation of the overload coupling 7 is sensed by the detector 29 which device emits a signal to the control center 30. The control center 30, in response thereto, sends a signal to the crane control 25, with the result that control breaks off its normal crane operation and the crane functioning stops. Further, control center 30 issues an activation signal to the service brakes 11 and 18, which causes both the drive and driven trains 3 and 4, respectively, to be blocked. This action prevents the object 16 in transport and powered by the motor 5, 5' from freely dropping itself without restraint.

The service brakes 11, 18 in the embodiment here illustrated are constructed as normal, commercially available brakes, which close upon spring loading and, by means of an appropriate compressed air apparatus, (not shown), which opposes the said spring, can be opened (i.e., released). Such air equipment operates in many cases under hydraulic control, that is to say, an electric motor builds a hydraulic pressure by means of a hydraulic pump in a piston cavity which acts to oppose a loading spring. The corresponding piston, when energized by a sufficiently high pressure, releases the brake by means of a levered linkage. The release of the brake can also be effected by other means, such as magnetic devices or mechanical linkages. In the case of electrohydraulic brakes, the brakes are closed when, because of the electrohydraulic air apparatus, the pressure is sufficiently decreased. This decrease in pressure occurs chiefly when the input drive of the electric motor begins to drag, or is stopped.

The service brake 18, 18', which acts upon the cable drum 14, 14', can also be designed as a safety brake which can be directly released by hydraulic means. FIG. 3 shows how this may occur. The brakes 18, 18', are shown in FIG. 3 in a schematic diagrammatic fashion as being operated by a hydraulic system H. This hydraulic system H, in turn, is interconnected to send and receive overload signals to/from crane controls 25, 30 and overload sensor 29. Without pressure, brakes 18, 18' are in a closed state. These brakes may be opened only, if by means of the hydraulic system H, pressure is rebuilt in their pressure chambers 18*a*, 18*b*, 18*a*', 18*b*'. This pressure allows brake opening by overcoming the spring loaded closure of the service brakes. With the described increase in pressure in the said pressure chambers 18*a*, 18*b*, 18*a*', 18*b*', the action of the brakes 18, 18' on the cable drum 14 is additionally accelerated, since in the hydraulic circuit, the servo valves 32, 32' are instantly operated, which hastens the loss of pressure and thus brings about the said accelerated action of brakes 18, 18'. Valves 32, 32' respond to controllers 25, 30 or directly to a signal from the overload sensor 29. In this way, assurance is provided, that the object being lifted, immediately upon the detection of overload, is secured from fall by a blocking of the cable drum 14. The pressure is so quickly reduced, that the braking action occurs within a set duration of 40 to 70 milliseconds. There are also designs, whereby the braking can take place more quickly than 40 milliseconds (namely within 20 milliseconds). In another embodiment, not shown here, the brake 18 can act directly on the cable 15 or directly restrict the output shaft 12. The service brake 11 is likewise closed upon a signal from the control 30.

Immediately upon the detection of an overload occurrence, the overload coupling 7 decouples itself, whereby the motor 5 is freed from the drive train 3 and the brakes 11 and 18 close as described above. Simultaneously, an activation of the crane or the hoist equipment is halted by the crane control 25 and the operation of the crane is interrupted. Optionally, it is possible that the gear drive segments 2 can be separated from one another by means of the controllable coupling 19.

Following the above stopping of the crane 1 function, in order to bring the crane 1 back into normal operation, operations are taken as follows: Using the operational element 26, a load-release signal is given to the control 30. This signal releases service brake 18 and controls the drive side brake 11 in such a manner, that this opens and frees the brake disk 9 to such an extent, that brake disk 9 begins to slip due to the action of the weight of the lifted load. Thereby, the object in transport 16 slowly lowers itself by its weight. The speed of this lowering is detected and measured by a speed sensor 31, which thereupon issues a corresponding signal to the control 30. The control of the service brake 11 is so carried out, that the transported load lowers itself at a constant speed. This speed of lowering corresponds to a set speed of rotation established by the speed sensor 31 which sensor is on the gear drive 2 side coupling-half of the overload coupling 7.

The regulation of the service brake 11 to obtain an unloading speed at the most possible constant rate is carried out in the following manner: The electrohydraulic air equipment of the service brake 11 possesses a frequency controlled, electric motor for the operation of a hydraulic pump. The controlling frequency of the electric motor is adjusted by control 30 through an installed frequency converter. As long as the speed of rotation detected by a speed sensor 31 lies below a predetermined minimum value, during which the lowering speed of the drum 14, 14' is also below a set speed of rotation, the motor controlling frequency is automatically allowed to increase and the brakes are correspondingly relaxed until a predetermined safe speed of lowering is attained. At this desirable point, the controlled frequency to the motor is held constant. Should, however, sensors show that the rotational speed of the drums 14, 14' exceed the preset threshold level, then the said controlling frequency to the motor is reduced. When this occurs, the speed of the motor is reduced and correspondingly, the hydraulic pressure opposing the spring loaded brake closure is reduced, causing the braking effect to increase, so that the rotational speed of the drum (or drums) is reduced and the speed of travel of the object being lowered is lessened.

In regard to the achievement of a uniformly constant speed of material transport, the controlling frequency to the electric motor is increased or decreased within an adjustable, preferably memory stored slope curve. This frequency slope is brought into such matching agreement with the entire system, that a continuous slippage of the brakes is acquired without the presence of so-called chattering or stick-slip effects. This desirable situation is enhanced by a proportional integration derivation (PID) type regulator.

By means of trimming buttons, namely 28, 28' it is possible to allow the controlled lowering of an overloaded burden to be individually adjusted to meet the needs of such twin hoisting arrangements as are shown in FIG. 1. This individual control becomes of value, if the lifted object, i.e., a container, becomes tipped or slanted in its suspension in a restricted delivery shaft. If this situation arises, the lifted object 16 is desirably brought into the relief state and the overload coupling 7 is adjusted and closed. Under these now corrected conditions, the state of each system is automatically reviewed, control 30 is deactivated and the lifting equipment in its totality is again placed under the regulation of the crane control 25.

The control procedure for the left side of the lifting equipment 1, as explained above, is equally valid for the right side of the lifting equipment. In this way, the control can be so designed, that is operates on both driving halves, namely 3, 3'. However, the possibility exists, that two interlocked controlling systems 30, 30' can be provided, wherein, if required, they can even replace one another. This replacement would permit in an emergency overload, a redundancy of safety operations, to the effect that functional security is increased.

In the above described embodiment, the service brakes 18 and 11 are controlled. These brakes are included in conventional hoisting equipment in the above described manner. Accordingly, no additional components are required. In an alternate embodiment, it is even possible, that the controlled lowering of the transported goods during an occurrence of overload can be regulated by an additionally installed braking arrangement. As another alternative, the service brakes 18, 18', which act upon the cable drum 14, 14' respectively, can be incorporated in a system of their own braking technology, whereby the overload sequence would be carried out by these brakes.

Control of the overload lowering can be executed, not only by the described commercially available brakes, but also by brakes which function with a simpler control, while still maintaining a constant speed in the lowering operation. Possibly such brakes could be hydraulic, pneumatic, or even driven with linear, electrical operation. These can be additionally furnished to the existing brake system to act in the "snag-case" obstruction of the lift.

The above described control and regulation arrangement is presented here in connection with the lifting equipment of a container crane. The controlling principle for a lowering of the object being lifted without driving power, after the detection of an overload, can be extended to cover the requirements of other material handling equipment including elevators, cable cars, lifting equipment, and the like.

Additional embodiments and alternates to the solution of overloads become evident to the expert in the claims which follow.

The invention claimed is:

1. A control and regulation arrangement for assuring the overload safety of a conveyor apparatus (1), which comprises:

a brake system (11, 11', 18, 18') which acts upon the conveyor apparatus (1), a control (30) for the said brake system (11, 11', 18, 18'), an overload sensor (29), which detects overload conditions and issues an overload signal, and a speed sensor (31; 24, 24') which detects the speed of an object (16) in transport and issues a signal of the same, whereby the control (30) reacts upon the brake system (11, 11', 18, 18') in response to the overload signal in such a manner, that the brake system stops the conveyor apparatus (1) and thus protects the object in transport (16), and whereby the control (30), following a subsequent unloading signal, releases the said stoppage of the conveyor apparatus (1) to such an extent, that the conveyor apparatus (1), responding to the weight of the object in transport (16), enters into an unloading state, and the action of the brake system (11, 11', 18, 18') restricting the conveyor apparatus (1) becomes so regulated in keeping with the signal from the speed sensor (31; 24, 24') that the object in transport (16) is caused to move at an approximately constant speed within the said unloading state.

2. A control and regulation arrangement in accord with claim 1, wherein the brake system (11, 11', 18, 18') is designed with spring loaded brakes having a thruster and the control (30) regulates the said thruster.

3. A control and regulation arrangement in accord with claim 2, whereby the thruster is designed as an electrohydraulic thruster while the control (30) includes a frequency converter which regulates the said electrohydraulic thruster by means of variance of frequency.

4. A control and regulation arrangement in accord with claim 3, whereby the control (30), adjusts the control frequency to correspond to a stored frequency curve.

5. A control and regulation arrangement in accord with claim 4, whereby the control frequency profile is a slope curve, and whereby the control (30), upon an overstepping of a first conveyor speed, follows an increasing frequency slope, and whereby the control (30), upon an understepping of a second conveyor speed, follows a declining frequency slope.

6. A control and regulation arrangement in accord with claim 1, whereby the control (30) upon the overload signal actuates a second brake system (11, 11', 18, 18') stopping the conveyor apparatus.

7. A control and regulation arrangement in accord with claim 6, whereby the control (30) regulates a hydraulic valve (32, 32'), which valve relieves the pressure in an electrohydraulic thruster of the second brake system in order to cause the second brake system to stop the conveyor apparatus.

8. A control and regulation arrangement in accord with claim 7, whereby the hydraulic valve (32, 32') is so designed, that the action of the second brake system takes place within a duration of 40 to 70 milliseconds.

9. A control and regulation arrangement in accord with claim 1, whereby the overload signal is released by means of an overload coupling (7, 7').

10. A control and regulation arrangement in accord with claim 9, whereby the separation of the overload coupling (7, 7') is detected by means of a difference in speed of rotation between two halves of said coupling.

11. A control and regulation arrangement in accord with claim 9, whereby the separation of the overload coupling (7, 7') is detected by means of the parting movement of the halves of the said coupling, this detection being sensed by a proximity switch.

12. A conveyor apparatus with a control and regulation arrangement in accord with claim 1, whereby the conveyor apparatus is designed as a cable hoist, as a crane equipment, or as a component of a container crane installation.

13. Crane equipment with a pair of conveyor apparatuses in accord with claim 12, which pair is synchronized in the vertical travel of a container spreader, whereby the said pair of conveyor apparatuses possess a common control (30).

14. Crane equipment in accord with claim 13, wherein, during an overload occasion, the synchronization of the conveyor apparatuses can be omitted, and the control (30) caused to act, selectively in accord with the unloading signal, on the brake system (11, 11', 18, 18') of one, or both, the conveyor apparatuses.

* * * * *